United States Patent [19]

Williams

[11] Patent Number: 4,747,375

[45] Date of Patent: May 31, 1988

[54] DEVICE FOR CONTROLLING THE PHASED DISPLACEMENT OF ROTATING SHAFTS

[76] Inventor: John K. Williams, 2975 Duke of Gloucester, East Point, Ga. 30344

[21] Appl. No.: 853,405

[22] Filed: Apr. 18, 1986

Related U.S. Application Data

[60] Division of Ser. No. 541,515, Oct. 13, 1983, Pat. No. 4,583,501, which is a continuation-in-part of Ser. No. 413,520, Aug. 31, 1982, Pat. No. 4,476,823.

[51] Int. Cl.[4] ..... F01L 1/34

[52] U.S. Cl. ..... 123/90.15; 464/160; 74/395

[58] Field of Search ..... 123/90.15, 90.16; 464/2, 3, 4, 1, 160; 74/395, 401

[56] References Cited

U.S. PATENT DOCUMENTS

| | | | |
|---|---|---|---|
| 410,425 | 9/1889 | Matthews | 74/395 |
| 841,444 | 1/1907 | Richards | 74/395 |
| 1,273,044 | 7/1918 | Diehl | 464/4 |
| 1,649,812 | 11/1927 | Crompton | 74/395 |
| 1,758,439 | 5/1930 | Goldschmidt | 464/160 |
| 2,038,728 | 4/1936 | Gilbertson | 74/395 |
| 2,096,999 | 10/1937 | Sarazin | 464/4 |
| 2,409,050 | 10/1946 | Ledwinka | 74/395 |
| 2,677,971 | 5/1954 | Greenwood | 74/395 |
| 2,700,903 | 2/1955 | Bohme | 74/395 |
| 2,810,275 | 10/1957 | Peterson | 464/160 |
| 2,884,799 | 5/1959 | Giannuzzi | 74/395 |
| 3,078,711 | 2/1963 | Shutt | 464/4 |
| 3,301,010 | 1/1967 | Vernick | 464/2 |

FOREIGN PATENT DOCUMENTS

| | | | |
|---|---|---|---|
| 21715 | 9/1907 | United Kingdom | 74/395 |
| 517105 | 1/1940 | United Kingdom | 74/395 |

*Primary Examiner*—Ira S. Lazarus

*Attorney, Agent, or Firm*—James J. Brown

[57] ABSTRACT

A device is disclosed for controlling the respective phased rotation relative to one another of two rotating shafts. The device of the invention finds particular application with respect to automotive engines and sequential operations associated therewith. The rotational displacement, for example, of a cam shaft used to control the opening and closing of engine valves can be controlled with respect to the phasing of rotation of the crankshaft of an engine. The invention finds particular application with regard to a unique, cam actuated valve lifter. In addition, such functions as fuel injection, ignition timing and other sequential operations in an internal combustion engine can be controlled relative, for example, to the rotation crankshaft.

6 Claims, 5 Drawing Sheets

DEVICE FOR CONTROLLING THE PHASED DISPLACEMENT OF ROTATING SHAFTS

CROSS-REFERENCE TO RELATED PATENT APPLICATION

This application is a divisional of application Ser. No. 541,515 filed Oct. 13, 1983 and now U.S. Pat. No. 4,583,501, which is a continuation-in-part of applicant's co-pending application Ser. No. 413,520 filed Aug. 31, 1982, now U.S. Pat. No. 4,476,823 entitled "Valve Timing Control Device" which describes a fluid activated device for variably controlling valve timing in relation to turning of a rotating shaft.

SUMMARY OF THE INVENTION

The present invention is directed to a device for controlling the phased rotation, relative to one another, of two rotating shafts and finds particular application with respect to automotive engines and sequential operations associated therewith. The present invention is especially concerned with a device for controlling and varying the valve timing or other sequential functions of an internal combustion engine and can be used in conjunction with valve actuators for opening and closing the intake and exhaust valves of the engine and cams mounted on a shaft rotating at a controlled rate to activate the actuators, the periodic rotation of the cams being varied by advancing or retarding a planetary gear assembly in relation to the revolution of a rotating shaft turned by the engine.

BACKGROUND OF THE INVENTION

Many of the present problems in society can be linked to the inefficient consumption of petroleum and the resulting rising cost and environment pollution. Reduction of our petroleum consumption rates increases the health of our society and economy. In addition, reduction of consumption rates assures that more of this valuable resource will be left for our prodigies to enjoy. Even the quality of our environment and the air we all breathe would be improved by more fuel efficient transportation vehicles.

THE PRIOR ART

The inventor is aware of the following prior art which is considered most relevant to the present invention.

U.S. Pat. No. 3,313,280 to Arutunoff et al. discloses a mechanism by which the valves of an internal combustion engine are opened and closed by a rocker arm which is pivotally mounted and responsive to a pair of laterally spaced cams.

U.S. Pat. No. 3,683,874 to Berlyn describes a valve actuating means in which a pump delivers oil under high pressure to a slave cylinder fitted with a piston.

U.S. Pat. No. 4,153,016 to Hausknecht describes a mechanism for regulating the opening of an engine valve during each cycle of operation by means of a hydraulically controlled system.

Additional less relevant patents which describe various valve regulating mechanisms are:

U.S. Pat. No. 3,004,410 to Pierce; U.S. Pat. No. 3,277,874 to Wagner; U.S. Pat. No. 3,612,015 to Hausknecht; U.S. Pat. No. 3,626,720 to Meacham et al.; U.S. Pat. No. 3,687,010 to Paxton; U.S. Pat. No. 3,817,228 to Bywater; U.S. Pat. No. 3,986,484 to Dyer; U.S. Pat. No. 4,203,397 to Soeters, Jr.; and U.S. Pat. No. 4,244,553 to Escobosa.

DESCRIPTION OF THE INVENTION

Figure 1:
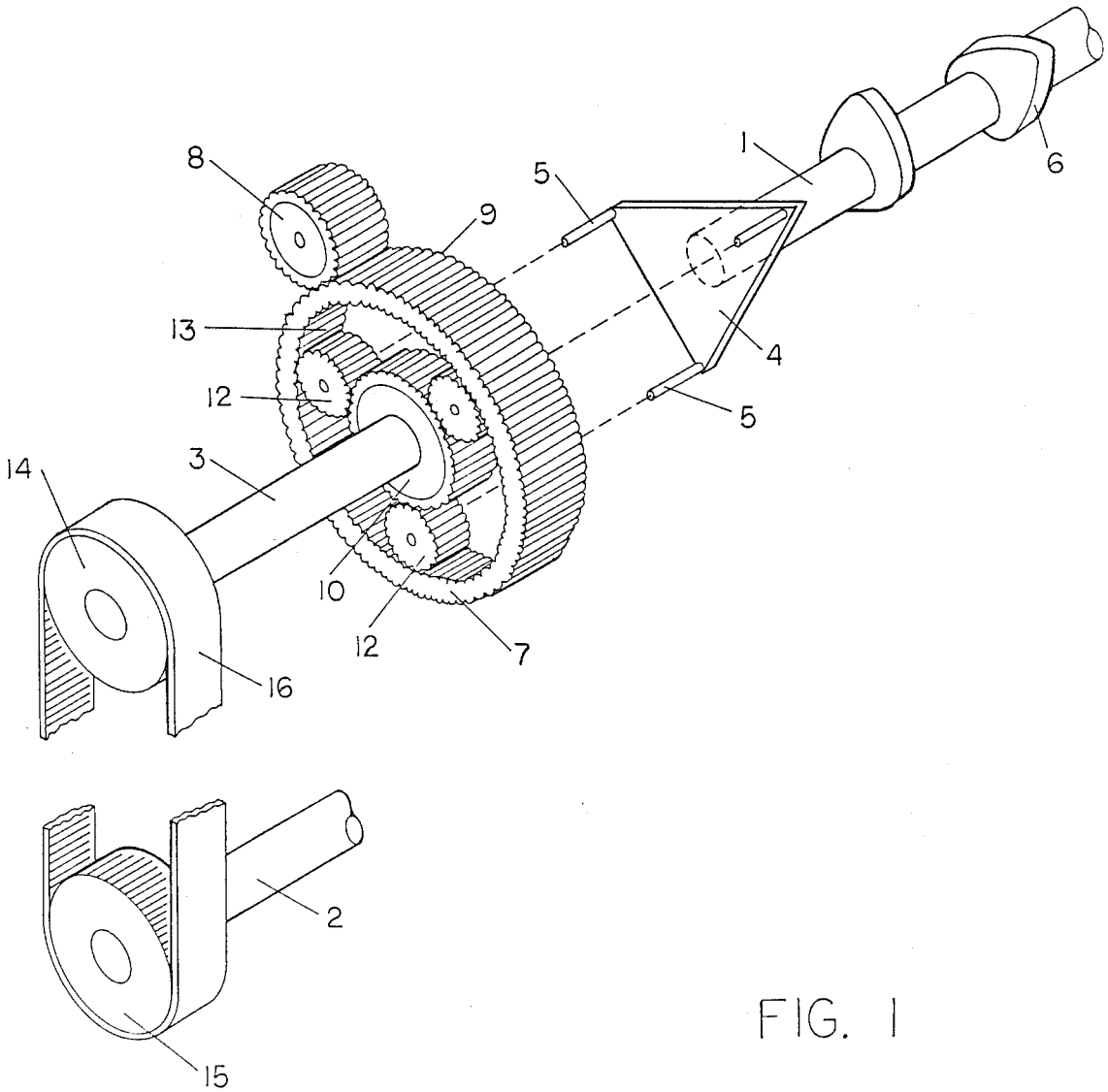
FIG. 1 illustrates the device of the invention whereby the rotational phase relationship of the crankshaft and camshaft are varied by a servo-motor.

In accordance with the present invention a device is provided for controlling the phased rotational displacement of one rotating shaft in relation to another rotating shaft. The invention has particular application with respect to automotive systems since it permits variation in the phased rotation of a cam shaft or other shaft controlling, for example, fuel injection or electrical/mechanical functions of the engine in relation to the crank shaft. The phased rotation of pairs of cam shafts, for example, can be controlled in relation to the rotation of a crank shaft thereby controlling the sequential timing of the opening and closing of the engine valves.

It will be appreciated that the basic device of the present invention for controlling the phased rotation of one turning shaft in relation to another turning shaft can assume several configurations which are considered to fall within the scope of the present invention. In one embodiment, a plurality of planet gears is rotatably mounted on a gear carrier which is disposed on a first rotating shaft to cause rotation of that shaft. These planet gears are also disposed around and engage a sun gear which is mounted on a second rotating shaft. The planet gears further engage the inner periphery of the ring gear which encloses them and which is turned by the third rotating shaft which may for example be the crank shaft of the engine. The relative phased rotation of the first shaft to the third shaft is controlled by means of the second rotating shaft on which the sun gear is mounted. Rotation of this shaft and its associated sun gear advances or retards the rotation of the first turning shaft in relation to the third turning shaft depending upon which direction the rotating shaft is moved. As an alternative the relative rotation of the second to the third shaft can be controlled by means of the first shaft.

In a second embodiment of the present invention the plurality of planet gears are again rotatably mounted on a gear carrier which is disposed on the first rotating shaft to cause its rotation. These planet gears are also again disposed around and engage a sun gear which is mounted on a second rotating shaft. The planet gears engage the inner periphery of the ring gear however in this embodiment the rotating shaft if directly turned by the third rotating shaft such as the crank shaft and the rotation of the first shaft relative to the third shaft is controlled by controlling the rotation of the ring gear. Conveniently, rotation of the ring gear is controlled by providing teeth on the outer periphery of the gear which engage a gear attached to the shaft of a small motor so that it can be turned in either direction to either advance or retard the ring gear.

In each instance one shaft is used to advance or retard displacement of the other two shafts relative to one another. As a practical matter, therefore, the control shaft will only turn when required to alter the displacement of one of the other shafts relative to the third, and may, in fact, be locked against rotation otherwise.

As previously noted, the present invention can be used in conjunction with sequential operation, for example, of the ignition and/or fuel injection system of an engine but finds particular utility when used in conjunction with a pair of shafts having cams mounted thereon which in turn control the raising and lowering of an engine valve thereby permitting adjustment of the valve sequence in relation to the turning of the crank shaft of the engine. In accordance with this embodiment of the present invention a valve is provided which has a stem extending from it perpendicularly and a slot provided longitudinally in a portion of the valve stem. A wedge shaped valve lifter is slidably disposed in this slot so that it can move horizontally in the slot transverse to the axis of the valve stem. The wedge shaped valve lifter has an inclined upper surface such that the height of one end of the wedge is less than the height of the slot of the valve stem and the height of the other end of the wedge is greater than the height of this slot. Disposed at either end of the wedge shaped valve lifter are resilient plunger-like devices which may, for example, be spring loaded and which are adapted to exert a lateral force against either end of the wedge to cause transverse sliding through the slot which in turn causes a raising or lowering of the valve stem. The upper end of the valve stem is provided with a spring or similar device for exerting a downward pressure on the valve stem so that the top of the slot in the stem is in constant contact with the inclined upper surface of the sliding valve lifter wedge. Each of the plungers located on either side of the valve lifter engages at its other end a cam mounted on a cam shaft. These cam shafts in turn are controlled in the phase, and therefore sequence of rotation by the previously described devices for varying the rotation of the shaft in relation to the engine crank shaft. Rotation of the cam shaft and its associated cam will periodically exert a lateral pressure on the plunger which it engages to press against the wedge-shaped valve lifter thereby forcing it transversely through the slot in the valve stem. In the case where this pressure is exerted against the taller side of the valve lifter which is, at its maximum extent greater than the height of the slot in the valve stem, the sliding action through the valve stem slot will cause a raising of the valve stem and the valve since the top of the valve stem slot is kept in constant engagement with the top inclined surface of the lifter. Similarly, exertion of transverse force by the cam and plunger on the other smaller side of the lifter will force the lifter in a transverse direction through the valve stem slot thereby permitting the valve to be lowered.

DETAILED DESCRIPTION OF THE DRAWINGS

The present invention will however be more fully appreciated by having reference to the accompanying drawings. Directing attention to FIG. 1, a cam shaft 1 or other rotational shaft having mounted thereon, a plurality of cams 6 and has a planet gear carrier 4 disposed at one end of the shaft with a plurality of spindles or hubs 5 upon each of which is mounted a planet gear 12. The planet gears 12 are disposed around and engage a central sun gear 10 mounted on a rotating shaft 3. Disposed around the planet gears and the sun gear is a ring gear 7 having gear teeth 13 on its inner periphery which engage the teeth of the respective planet gears. The outer periphery of the ring gear is also provided with teeth 9 which engage external gear 8. Mounted on the rotating shaft 3 is a gear 14 which permits the shaft 3 and the sun gear 10 to be turned by means of a belt or chain 16 which is disposed on its other end around a similar gear 15 mounted on the crankshaft or other rotating shaft of the device. Thus, the relationship between the rotation of the shaft 2 and the cam shaft 1 is controlled by means of the gear 8 which turns the ring gear 7. Conveniently the gear 8 is mounted on a shaft having controlled rotation or directly to a servo motor which controls its rotation. Thus, advancing or retarding the rotation of the planet gear carrier 4 and the shaft 1 is accomplished by actual rotation of the sun gear 7.

Figure 2:
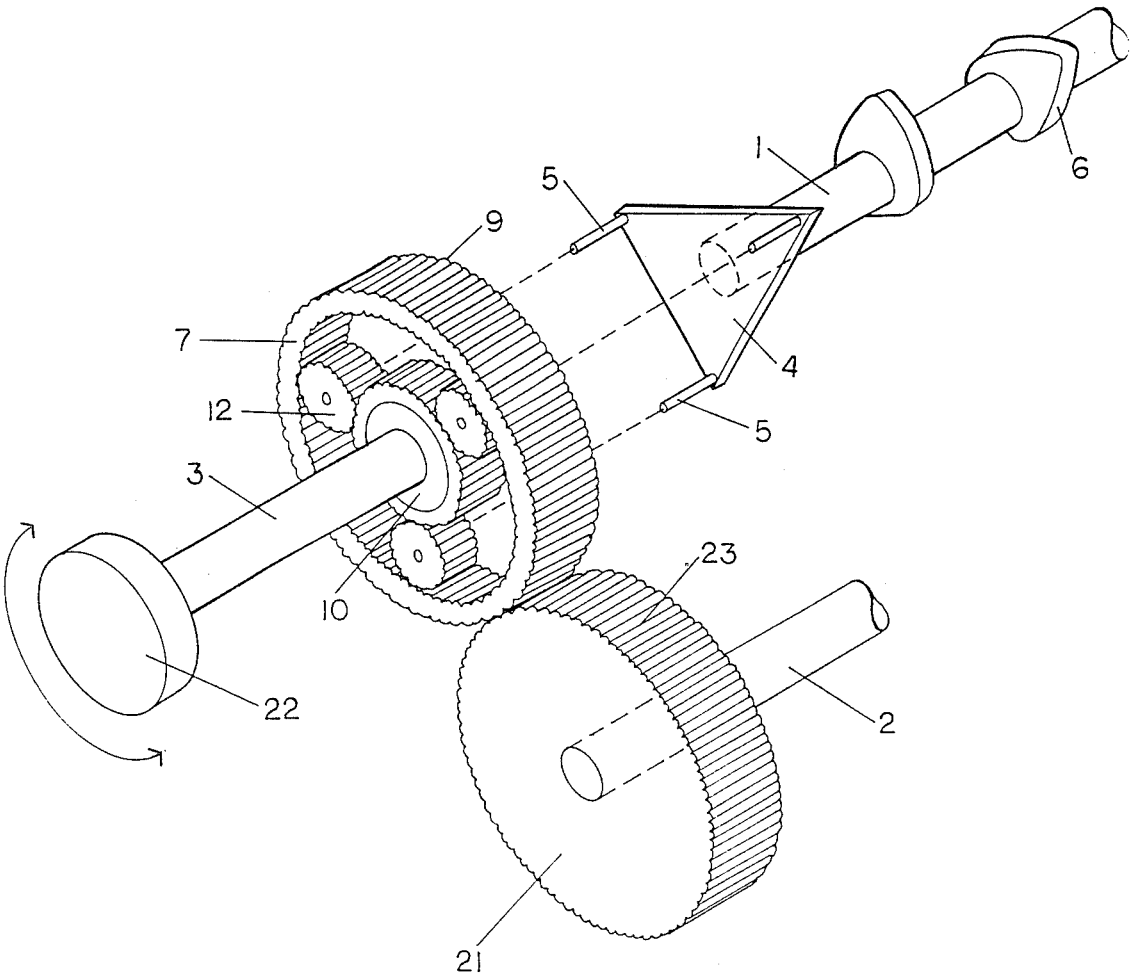
FIG. 2 illustrates an embodiment of the invention whereby the rotational phase relationship of the crankshaft and camshaft are controlled through the rotation of a sun gear.

Directing attention to FIG. 2 of the drawings, a similar device for advancing or retarding the rotation of the shaft 1 is shown. In this instance, however, the ring gear 7 is turned directly by gear 21 whose teeth 23 engage the teeth 9 of the ring gear. The gear 21 is itself directly mounted on the shaft 2. Movement of the ring gear imparts rotation to the planet gears and thus to the planet gear carrier 4 and shaft 1. Advancing or retarding the rotation of the planet carrier in this instance is, however, accomplished by rotating the sun gear 10 mounted on the shaft 3 having a gear or servo control 22 attached to it. As an alternative (not shown in drawings) the position and function of gear or servo control 22 on shaft 3 can be exchanged with cams 6 on shaft 1 so that rotational displacement of shaft 3 relative to shaft 2 is controlled through the planet gear carrier 4 and planet gears 12.

Figure 3:
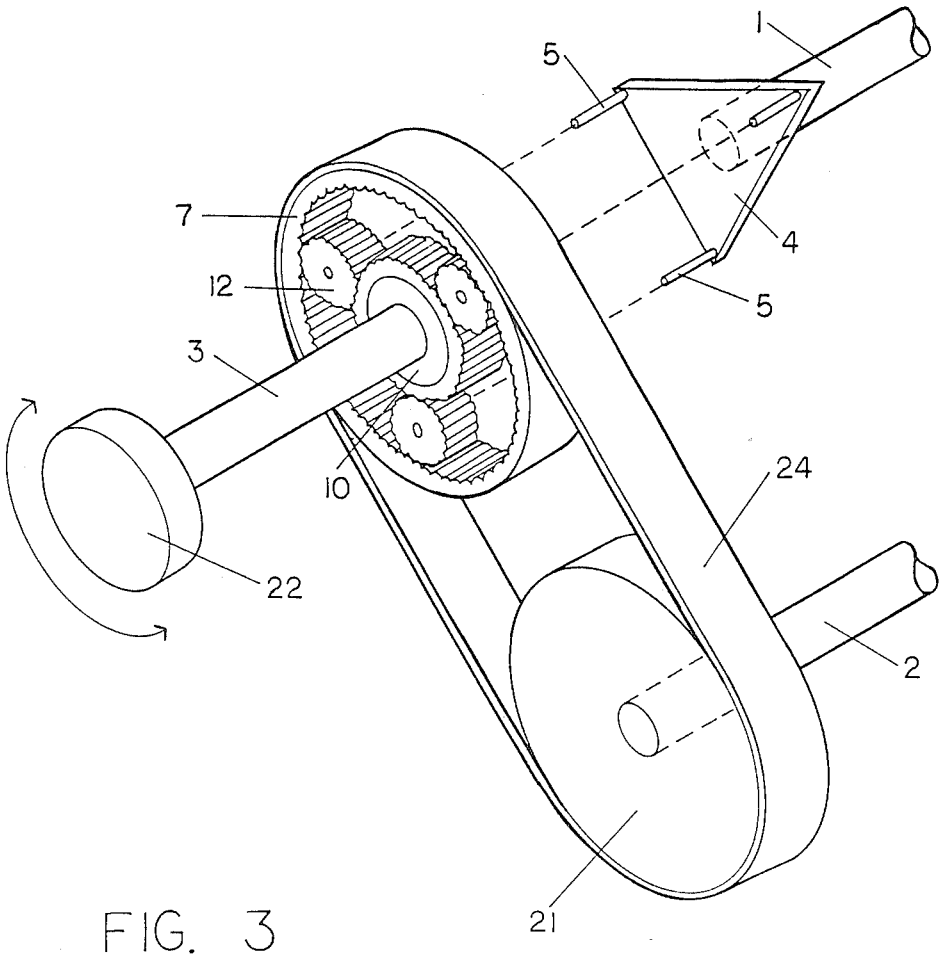
FIG. 3 illustrates an embodiment similar to FIG. 2 in which the crankshaft and ring gear are connected by means of a belt.

FIG. 3 of the drawings illustrates an embodiment of the invention which is functionally like that of FIG. 2 except that instead of the respective gears 7 and 21 having meshing teeth to impart rotation, a belt or chain 24 is provided so that rotation of the shaft 2 and the gear 21 causes the ring gear 7 to rotate. Advancing or retarding of the rotation is again accomplished by means of the control 22 mounted on shaft 3.

Figure 4:
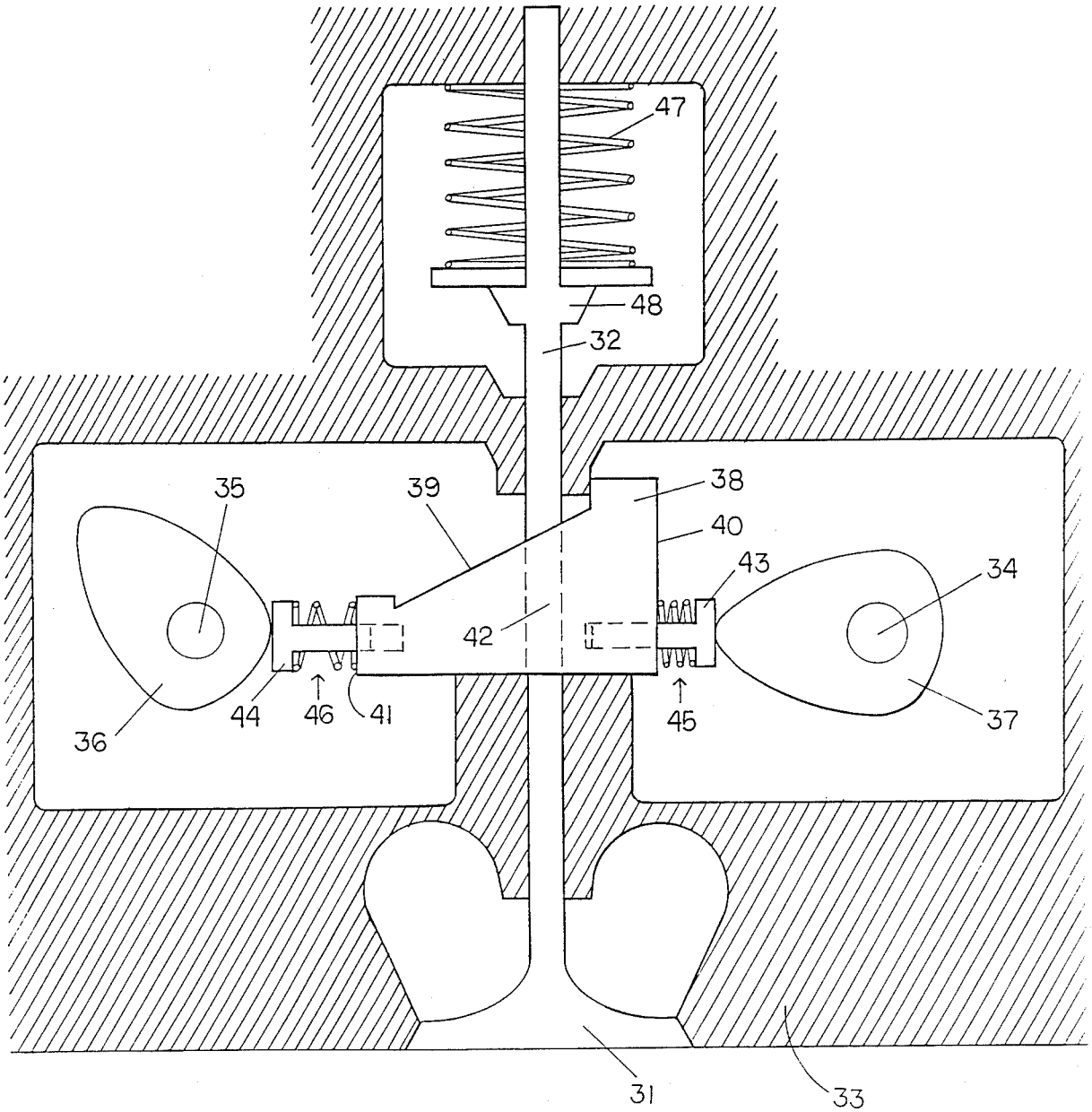
FIG. 4 is a cross-sectional illustration of the valve lifting device of the invention.

FIG. 4 of the drawings illustrates the unique valve lifting mechanism of the present invention which is advantageously employed in connecton with the device described in FIGS. 1 through 3. A valve 31 is disposed on the lower end of valve stem 32 and mounted in the block 33. The valve stem 32 is further provided with a slot 42 which accommodates the valve lifter wedge 38. The valve lifter wedge 38 has an inclined upper surface 39 such that one side 40 of the wedge is of greater height than the other side 41. The slot 42 provided in the valve stem is of a greater height than the shorter side of the wedge 41 but not as tall as the side 40. Respective cam shafts 34 and 35 are located on either side of the valve lifter and provided with cams 37 and 36, respectively. Conveniently, these cam shafts may, for example, be two of the rotating shafts 1 described in FIG. 1 through 3 of the drawings. The respective rotating cams 36 and 37 engage plungers 44 and 43 which are respectively provided with springs 46 and 45. Thus, alternating rotation of the cam shafts 34 and 35 cause the cams mounted thereon to alternately depress the respective plungers which they engage to cause the valve lifter wedge to slide back and forth laterally through the slot 42 in the valve stem. The upper portion of the valve stem 48 is provided with a spring or similar means for exerting downward force such that a constant downward pressure is exerted on the valve stem to thereby cause the top of the slot 42 to be always in contact with the inclined upper surface of the valve lifter wedge 39. As the wedge 38 moves back and forth through the slot there will thereby be an upward vertical force exerted and removed from the valve stem allowing it to rise and fall thereby opening and closing the valve 31. It will therefore be seen, that by controlling the rotation of the shafts 34 and 35 using the system described in FIG. 1 through 3 of the drawings, the valve timing of the engine can be controlled in relationship to the crankshaft.

Figure 5:
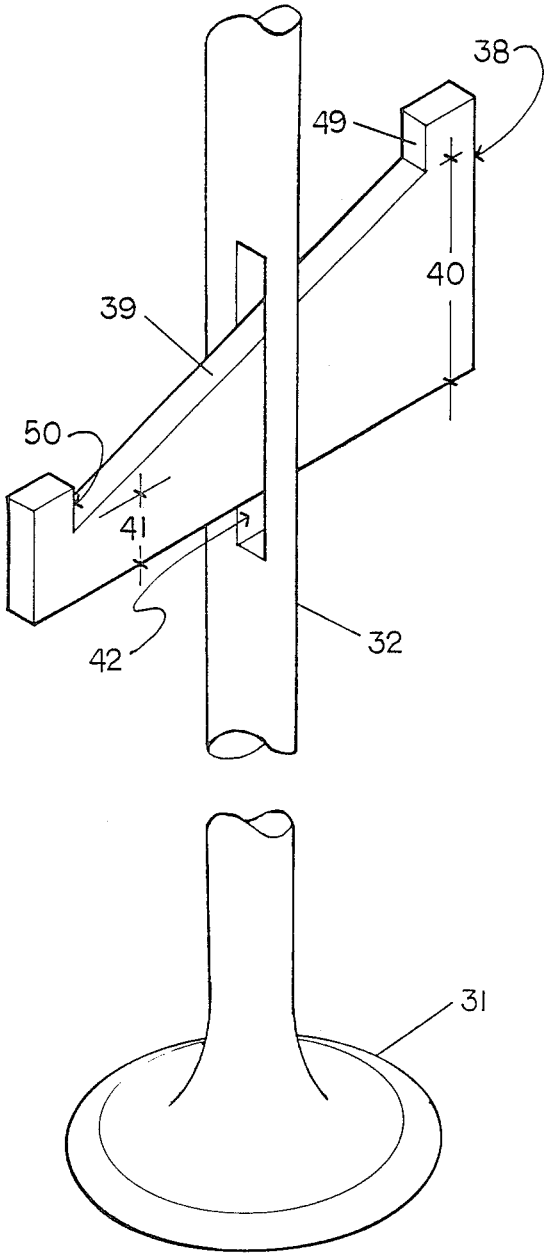
FIG. 5 is a close up view of the valve, valve stem and valve lifter of the invention.

FIG. 5 of the drawings illustrates further the valve lifter, stem and valve of the present invention. The valve 31 is provided with stem 32 having a slot 42 cut therein to accommodate transversely the wedge 38 having a height 40 on one side and 41 on the other. The top surface of the valve lifter 39 engages the top of the slot 42 to provide lift to the valve or to permit the valve to move downward to a closed position. Stops 49 and 50 are provided also on the upper surface of the valve lifter to prevent passage through the slot 42.

I claim:

1. A device for controlling independently of either shaft the rotation of a first turning shaft in relation to a second turning shaft having a non-concentric axis of rotation relative to said first turning shaft, which comprises a plurality of planet gears rotatably mounted on gear carrier means disposed on a said first turning shaft to cause rotation of said planet gears, said plant gears being also disposed around and continuously engaging a sun gear directly mounted concentrically on a controlled rotating shaft having a common axis of rotation with a said first turning shaft, said planet gears further continuously engaging the inner periphery of a ring gear which is turned by said second turning shaft, the relative phasing rotation of said first shaft to said second shaft being controlled by means otherwise independent of said first and second shafts for turning said controlled rotating shaft on which the sun gear is mounted.

2. The device of claim 1 wherein said ring gear is turned by means of a belt connecting it with said second turning shaft.

3. The device of claim 1 wherein said ring gear has gear teeth on its outer periphery which engages a gear on said second turning shaft to transmit rotation thereto.

4. The device of claim 1 wherein said second shaft is the crankshaft of an automotive engine.

5. A device for controlling independently of either shaft the rotation of a first turning shaft in relation to a second turning shaft having a non-concentric axis of rotation relative to said first turning shaft, which comprises a plurality of planet gears rotatably mounted on a gear carrier disposed on said first turning shaft to cause rotation thereof, said plant gears being also disposed around and continuously engaging a sun gear mounted on a rotating shaft, said planet gears also continuously engaging the inner periphery of a ring gear, said rotating shaft being turned by said second turning shaft and the relative rotation of said first turning shaft to said second turning shaft being controlled by means for turning said ring gear operatively connected to the outer periphery thereof and otherwise independent of said first and second shafts.

6. The device of claim 5 wherein said second shaft is the crankshaft of an automotive engine.

* * * * *